United States Patent [19]

Pertl

[11] 4,274,215

[45] Jun. 23, 1981

[54] METHOD OF SMOOTHING FLAT GOODS

[75] Inventor: Don L. Pertl, Columbia, S.C.

[73] Assignee: Western Automation Corporation, Redmond, Wash.

[21] Appl. No.: 2,093

[22] Filed: Jan. 9, 1979

[51] Int. Cl.[3] ..... D06F 71/34

[52] U.S. Cl. ..... 38/144; 38/15

[58] Field of Search ..... 38/1 B, 2, 3, 15, 144; 223/37, 38

[56] References Cited

U.S. PATENT DOCUMENTS

| | | | |
|---|---|---|---|
| 634,652 | 10/1899 | Sarfert | 38/144 |
| 2,645,044 | 7/1953 | Zimarik | 38/2 |
| 2,663,954 | 12/1953 | Goldman | 38/15 |
| 2,759,277 | 8/1956 | Malnick | 38/2 |
| 3,795,995 | 3/1974 | Johnson | 38/2 |

FOREIGN PATENT DOCUMENTS

| | | | |
|---|---|---|---|
| 311297 | 5/1929 | United Kingdom . | |
| 376500 | 7/1932 | United Kingdom . | |
| 410335 | 5/1934 | United Kingdom . | |
| 593504 | 10/1947 | United Kingdom . | |
| 693534 | 7/1953 | United Kingdom | 38/144 |
| 711772 | 7/1954 | United Kingdom . | |
| 981035 | 1/1965 | United Kingdom . | |
| 1184627 | 3/1970 | United Kingdom . | |
| 1290899 | 9/1972 | United Kingdom . | |
| 1291484 | 10/1972 | United Kingdom . | |

*Primary Examiner*—Louis Rimrodt

*Attorney, Agent, or Firm*—Dann, Dorfman, Herrell & Skillman

[57] ABSTRACT

A method for processing table and bed linen which embodies no-iron fabrics which may be composed in at least a substantial part of polyester fiber, or may be composed of other fibers which have been treated to provide no-iron characteristics (linen being used in a generic sense rather than to identify the fiber composition). The process includes the sequential steps of laundering the linen, preferably in substantially conventional manner, and then folding the laundered linen in a dry state to provide a stack of multiple layers of the laundered textile fabric, all of the layers being of approximately equal area. The multiple layers of fabric are then finished by compressing the multiple layers in folded state in the presence of heat and moisture, causing steam to flow through the stack of multiple layers, first in one direction and then in the opposite direction. The flow of steam through the stack of layers is assisted by injecting the steam against the layer at one end of the stack and applying vacuum to the layer at the opposite end of the stack so that the vacuum assists the flow of steam through the entire stack. Following this operation, the steam and vacuum are reversed, causing the steam to flow in the other direction.

3 Claims, 7 Drawing Figures

METHOD OF SMOOTHING FLAT GOODS

The present invention relates to the processing or treatment of bed and table linen and has particular application to the laundering of linen which is used in places of public accommodation such as hotels, motels, restaurants, and the like.

Traditionally, table linen or napery and also bed linen were woven from linen threads or other yarns which were machine washable and required ironing in a wet or damp-dry state in order to remove wrinkles and the like and present satisfactory finish. To retard wrinkling after ironing and folding, generally a small amount of starch or other finishing treatment was applied to the linen in the final wash, which after pressing retained the smoothness of the ironed linen.

With the advent of no-iron materials, such as fabrics made of polyester materials and fabrics made of other materials which may have been treated to produce no-iron characteristics in the fabric, it has been desired to take advantage of these modern fabrics to avoid the need for ironing the table linen and bed linen. However, in domestic use of such no-iron fabrics, the best results are achieved when the fabrics are folded immediately after removal from the dryer or are allowed to hang out before being stored so that any wrinkles from the washing operations can be removed by hanging. In large volume operations, however, it is not practical to hang out the fabrics and it is difficult to control operation sequences to allow immediate folding from driers prior to their being put away. The storage of the unironed, unhung or delay-folded fabrics tends to preserve the wrinkles and uneven creases in the fabrics and render them unsatisfactory for use. In order to eliminate the wrinkles and uneven creases which normally result from improper processing of no-iron fabrics, the fabrics may be pressed prior to use. The additional labor involved in this additional pressing or ironing operation is burdensome and in many cases, the linen is used without the application of this finishing touch.

Attempts to overcome the problems involved in this process have included the design of equipment which will press or iron the fabric in open width and which automatically folds the fabric after it is ironed in a manner to minimize the wrinkling or creasing of the fabric following its ironing. While such apparatus has been proved to be effective, the subsequent handling of the ironed and folded fabrics may introduce additional wrinkles or creases, thereby defeating the purpose of the final pressing.

Furthermore, the pressing of linen in open width requires large platens or rollers, as the case may be, and occuplies a large floor area, creates excessive heat, and is expensive to install, operate and maintain.

With the foregoing in mind, the present invention utilizes an apparatus which is compact and may be used to press (finish) napery and bed linen in a folded state so that it does not occupy excessive space, and may be conveniently operated as needed.

The present invention enables rapid processing of the table and bed linen through the forcing of steam through multiple layers of the linen in folded state, the steam being supplied at one side of the folded stack of material and being drawn out through the other side by vacuum, the process being repeated by reversing the flow of steam.

All of the objects of the invention are more fully set forth hereinafter with reference to the accompanying drawing, wherein.

Figure 1:
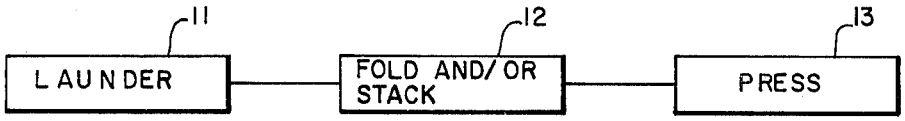
FIG. 1 is a block diagram showing the procedures of the method of the present invention.

FIG. 1 illustrates the multiple steps in the process involved in the present invention in which the bed linen and/or napery is first laundered by conventional laundering techniques as indicated by the block 11 and is then folded and/or stacked to provide a stack of multiple layers of the flat material as indicated by the block 12. The multi-layered stack of material is then pressed with the presence of steam as indicated by the block 13 whereby the mechanical pressure and the steam operate in conjunction to remove the wrinkles imparted to the material during the laundering process and provides a satisfactory finished appearance to the laundered products.

The invention is particularly applicable to bed linen and table linen or napery which has been fabricated of no-iron material. A typical no-iron material comprises a blend of cotton and polyester fibers which are flat-woven according to conventional techniques to impart a wrinkle and crease resistance to the fabric. Alternatively, the fabric may be made with other materials and then treated with resins or other treating agents to provide the no-iron characteristics which are desirable in flat goods of this character. Such material is readily laundered by conventional laundering techniques and the particular apparatus or method used in laundering the products in the first step of the method of the present invention are conventional.

Following laundering of the material, the large pieces are folded to a convenient size for handling. Preferably, the material is folded so that the length and width of each lap of the folded material is less than 24 inches by +inches so that the material may be laid flat on the platen of this size. The material is preferably folded uniformly so that the multiple laps or layers of the folded material are of approximately the same size and are stacked one on top of the other to form a compact stack of layers of the laundered material. When handling napkins and other flatware which may be of sufficiently small size to fit within the 24 inch by 30 inch platen, the napkins are assembled into a stack of multiple layers which permits the stack to be placed within the confines of the 24 inch by 30 inch platen.

The present invention permits the treatment of up to 128 layers of fabric in a single pressing operation, although preferably, the folded stack is composed of 64 to 96 layers of material depending upon the thickness of the fabric. For example, if table cloths are eight feet wide and ten feet long, it then may be folded twice lengthwise and three ways widthwise to fit on the platen and the folded tablecloth will have 32 layers or laps fitting within the 24 inch by 30 inch platen. A bed sheet which is 90 inches by 54 inches may be folded twice lengthwise and three ways widthwise to provide 32 layers or laps of fabric in this stack each measuring 30 inches by 18 inches. In such event, three to four sheets can be placed in the presser for pressing since the three to four sheets would combine to provide 96 to 128 layers or laps. Where the products are not of uniform width and/or length, certain of the layers must be of a lesser dimension than the remaining layers, but it will not impair the processing operation to incorporate a few smaller layers amongst the larger layers which are of substantially identical size.

The folding and/or stacking operation may be done manually or suitable folding apparatus may be used to perform this operation. Folding apparatus is available commercially and is described in some detail in patent literature, and it is not deemed necessary to include a description of such apparatus.

The final stage in the process of the present invention is the pressing operation as indicated by the block 13 in FIG. 1. In the pressing operation, the stack of material is placed between a pair of platens and the material is subjected to mechanical pressure as well as to steam pressure. In accordance with the invention, the steam is caused to flow through the entire stack of material by applying pressurized steam at one end of the stack and applying vacuum to the other end of the stack. This causes the steam to flow initially from the one end to the other end. Preferably, the process is repeated by supplying steam at the other end of the stack and applying suction to the one end so that the steam subsequently flows in the opposite direction from the other end of the stack to the one end. In this way the entire stack of material is subjected to the effect of the steam and it has been found effective to eliminate the wrinkles in the material through out all of the layers in the stack, particularly, when the number of layers in the stack is less than 128. The flow of steam is preferably timed so that the steam flows through the stack for a period of from 5 to 15 seconds, the initial flow of steam through the stack being for a period which is at least as long as and preferably longer than the subsequent period when the steam flows in the reverse direction. In this way, the sensible heat in the steam is effective to provide the necessary heat and moisture to combine with the mechanical pressure to be effective to eliminate the wrinkles and undesirable creases from each layer of material in the stack.

The process of this invention involves the sequential laundering, folding, and/or stacking, and pressing the flat goods. While this process can be performed manually, it is particularly well suited to automated production. To this end the apparatus may be installed in a line with the laundering apparatus at the head of the line from which the dried material is conveyed to a stacking apparatus which may consist of a folder-crossfolder or other suitable stacking and/or folding apparatus. The folded stacks from this latter apparatus may then be directly conveyed to the presser which can receive the stack between the platens and apply the necessary mechanical pressure and steam to the stack to accomplish the desired results.

With the foregoing in mind, the present invention provides a presser device which is uniquely suited to ironing multiple layers of flat fabric arranged in stacks.

Figure 2:
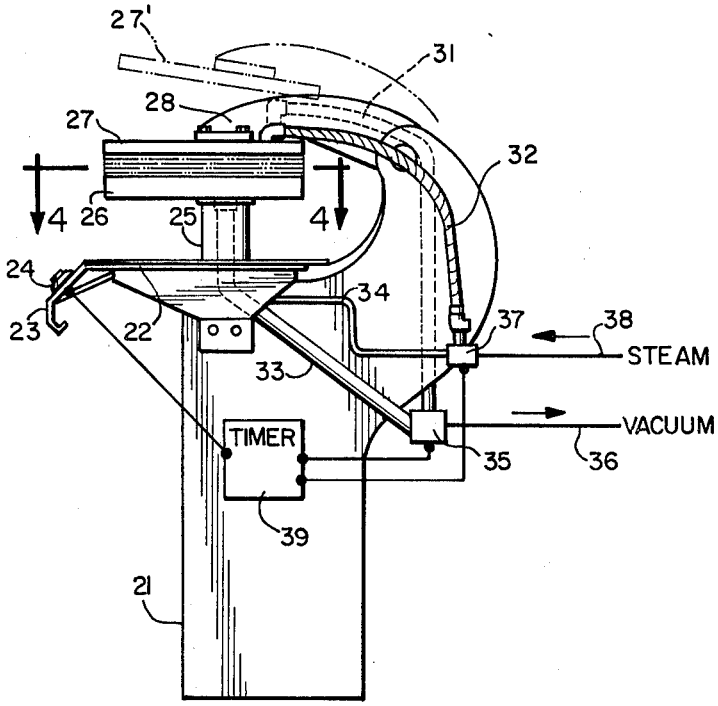
FIG. 2 is a view in side elevation of apparatus for finishing table and bed linen in accordance with the present invention.
Figure 3:
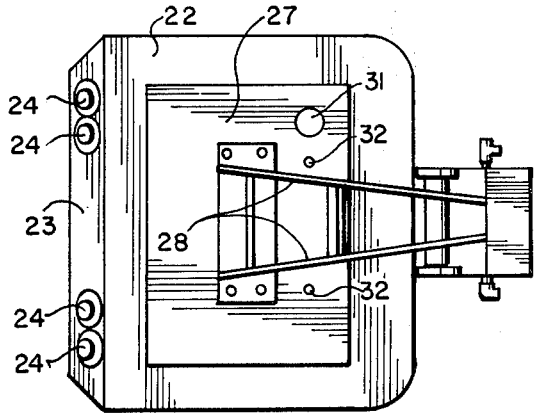
FIG. 3 is a top plan view of the apparatus shown in FIG. 2.
Figure 4:
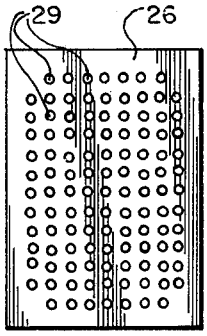
FIG. 4 is a fragmentary sectional view taken along line 4—4 of FIG. 2.

A suitable apparatus for performing the pressing operation is illustrated in FIGS. 2–4 inclusive. As shown, the apparatus comprises an upright stand or frame 21 having a table 22 with a depending lip 23 which mounts the operating controls 24. Mounted on the table 22 by a pressure cylinder 25 is a lower platen 26 upon which the stack of layers of material may be placed for the pressing operation. Cooperating with the lower platen 26 is an upper platen 27 which is mounted on a swing arm 28 for displacement between the closed position shown in full lines, and the open position shown in broken lines at 27' in FIG. 2. In the closed position, the upper platen is disposed approximately parallel to the lower platen at a predetermined height above the table 22. The pressure cylinder 25 which mounts the lower platen 26 permits the distance between the upper and lower platens to be adjusted to accommodate stacks of material of differing thicknesses. The pressure cylinder preferably is fluid-actuated so as to resilently mount the lower platen to assure that the desired mechanical pressure is applied to the material between the upper and lower platens 27 and 26, respectively. The pressure fluid within the cylinder 25 operates to resist the downward displacement of the lower platen with a predetermined pressure so that when the upper platen 27 is displaced to its operative position parallel to the table 22, the pressure fluid in the cylinder 25 is effective to apply a predetermined amount of mechanical pressure to the stack of layers of material between the platens.

In accordance with the present invention, the upper and lower platens are each perforated or foramenous on their confronting surfaces so as to permit the passage of steam therethrough. The platens may be of a suitable heat-resistant metallic material having passageways 29 (see FIG. 4) therethrough to provide the desired perforations, when deemed desirable, the surfaces may be padded or covered with a porous material to afford the flow of steam through these passageways into the stack of material.

In order to control the flow of steam through the stack of material between the platens 26 and 27, connections are provided for connecting the platens to a source of steam and a source of vacuum. In the present instance, each of the platens is hollow and constitutes a manifold to which the steam and vacuum may be alternatively connected. An alternate form of platen (not shown) comprises separate manifolds within the platen each communicating with a separate set of apertures so that the vacuum is connected to a vacuum manifold which is connected to vacuum passageways, whereas the steam is connected to a steam manifold having steam passageways extending therefrom.

The upper platen is provided with a vacuum connection 31 and a steam connection 32 and the lower platen is likewise provided with a vacuum connection 33 and a steam connection 34. The vacuum connections are coupled through valve means 35 to a source of vacuum 36. Similarly, the steam connections 32 and 34 are connected through valve means 37 to a source of steam 38. The valve means 35 and 37 are connected to suitable timing mechanism 39 which is effective to alternatively connect the steam and vacuum to the upper and lower platens, respectively. Thus, the timer preferably operates in a cycle to first connect the steam through the lower platen 26 and the vacuum to the upper platen 27.

The steam thereupon flows upwardly through the stack of material between the platens and for a predetermined time interval sufficient to assure flow of steam through the entire stack of material. Thereupon at the end of the first portion of the cycle, the valve means 35 and 37 are reversed by the timer to introduce steam to the upper platen 27 and connect vacuum to the lower platen 26. When this occurs, the steam is caused to flow downwardly through the stack of material between the stack of platens for a predetermined period to permit full penetration of the steam through the stack of fabric between the platens. This reversed flow thereby subjects the upper layers of the stack of material to fresh steam and the lower layers to spent steam, whereas in the previous portion of the cycle the lower layers were subjected to fresh steam while the upper layers were subjected to spent steam. After a predetermined time interval, the timer interrupts the flow of steam and vacuum to and from the platens respectively so that the upper platen may be displaced upwardly to permit removal of the stack of material from therebetween.

In FIGS. 2–4, the platens 26 and 27 are illustrated without padding or covering so as to expose the multitude of passageways 29 extending through the platen into the hollow interior thereof. The passageways 41 cover substantially the entire surface of the platen so as to afford flow of steam and application of vacuum over the entire surface area of the platen. Furthermore, for the purpose of illustration, the confronting surfaces of the platens are shown without any curvature, although in practice a degree of curvature is embodied in each platen to enhance the smoothing function accomplished by the application of mechanical pressure by the platens to the stack of fabric layers.

Figure 5:
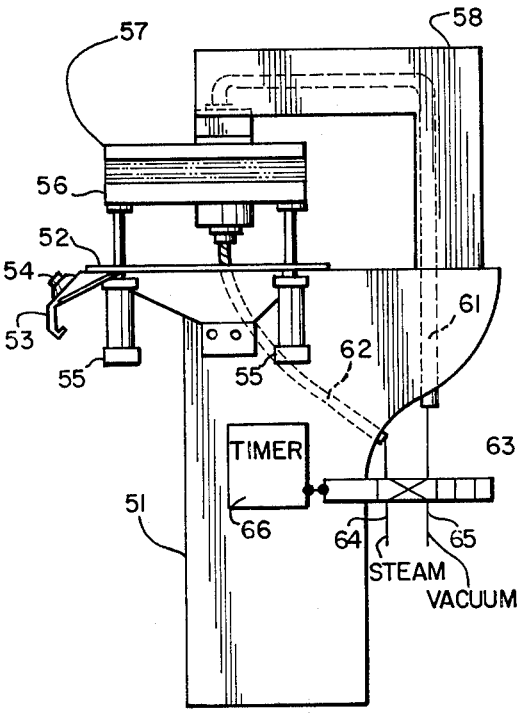
FIG. 5 is a view similar to FIG. 2 of an alternate embodiment of apparatus for performing the method of the present invention.
Figure 6:
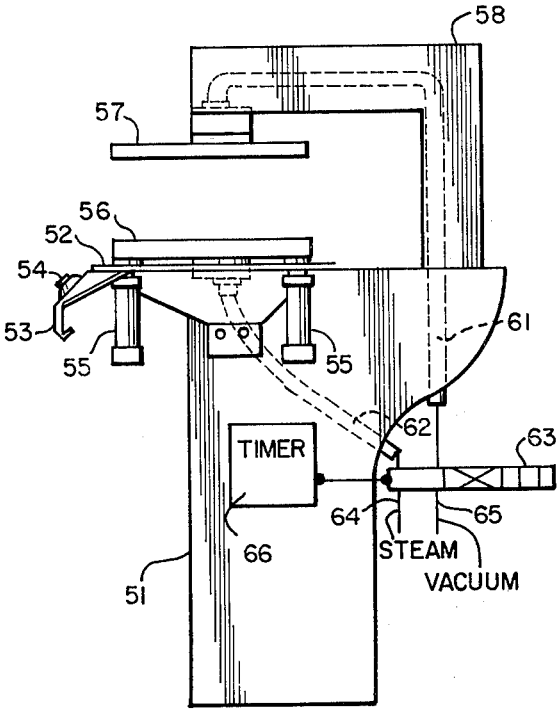
FIG. 6 is a view similar to FIG. 5 showing the apparatus in condition for receiving the material to be treated.
Figure 7:
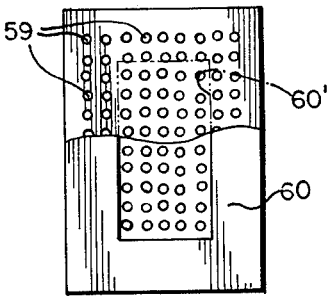
FIG. 7 is a view similar to FIG. 4 showing the face of the lower platen of the apparatus of FIGS. 5 and 6 illustrating a mask to accommodate a folded stack of smaller dimension, the mask being partially broken away for the purpose of illustration.

FIGS. 5 through 7 illustrate another embodiment of the apparatus which may be used to perform the pressing step of the process set forth in FIG. 1. Referring to the embodiment of the presser apparatus shown in FIGS. 5 through 7, the apparatus includes frame 51 which mounts a table 52 having a front lip 53 which mounts suitable controls 54 as in the earlier-described embodiment. The table 52 has a vertically-movable lower platen 56 mounted for displacement between the positions shown in FIGS. 5 and 6 by pressure-cylinders 55 positioned at each corner of the lower platen 56. Actuation of the pressure-cylinders 55, for example by one of the controls 54, enables the lower platen 56 to be dropped to the level of the table 52 to permit loading of the apparatus.

The lower platen 56 cooperates with an upper platen 57 which, in the present instance, is fixedly mounted on a suspension arm 58 extending over the table 52 as shown. The fluid pressure in the cylinders 55 is effective to apply a uniform upward pressure upon the stack of material positioned between the platens 56 and 57. As with the previously-described embodiment, the upper and lower platens 57 and 56, respectively, comprise hollow chambers having a series of passageways 59 extending through the confronting faces to permit the passage of steam or vacuum therethrough. Preferably, the passageways 59 cover the entire confronting surface of each platen 56 and 57 to afford penetration of the steam throughout the entire surface area between the platens. As shown in FIG. 7, a mask 60 is provided for the upper and lower platens to block the passageways 59 and reduce the effective perforated area of the platens when, for example, a stack of material of reduced dimension is placed therebetween. The mask 60 in the present instance is a rectangular mat extending about the entire periphery of the platen as shown in broken lines 60' in FIG. 7. The platen underneath the mask being perforated with the passageways 59 so that removal of the mask permits the full use of platen area for pressing purposes. The mask 60 may be mounted externally on the exposes surface of the platens, as shown, or it may be mounted internally of the platens to obstruct the internal ends of the passageways 59 against fluid flow therethrough.

The hollow platens 56 and 57 are connected, in the present instance by suitable conduits 61 and 62, to a valve means 63 which, in turn, is connected to sources of steam and vacuum through a suitable steam connection 64 and a vacuum connection 65. The valve mechanism 63 in the present instance is a reversing mechanism which permits the reversal of the connection of the steam and vacuum to the platens 56 and 57, respectively. With the valve in the illustrated position of FIG. 5, the steam connection 64 is made to the upper platen 57 through the conduit 61, whereas the vacuum connection 65 is made to the lower platen 56 through the conduit 62. Thus, steam is drawn through the stack of material between the platens 57 and 56 by the positioning of the valve means 63 in the illustrated position. In accordance with the operation described above, after a predetermined time period, the valve is actuated to reverse the flow of steam by connecting the upper platen 57 through the conduit 61 to the vacuum supply 65 and the lower platen 56 through the conduit 62 to the steam supply 64. After a further time period, the valve is then shifted to block the flow of steam and vacuum, for example as shown in FIG. 6 so as to permit the platens to be separated without discharging the steam. The timer means for controlling the valve means 63 is indicated at 66. The apparatus of FIGS. 5 through 7 lends itself to automatic operation and permits wide flexibility in the design of the operating mechanisms thereof to assure an effective pressing operation wherein the mechanical pressure applied to the stack of material between the platens 56 and 57 is accompanied by steam flow through the material first in one direction and then in the opposite direction.

As an alternative, the top platen may be mounted for vertical movement relative to a rigid bottom platen in order to obtain the relative displacement of the platens between open and closed positions respectively.

While particular embodiments of the present invention have been herein illustrated and described, it is not intended to limit the invention to such disclosure but changes and modifications may be made therein and thereto within the scope of the following claims.

What is claimed is:

1. A method of smoothing flat goods comprising fabrics having no-iron characteristics consisting of the steps of first laundering said fabrics, thereafter disposing of said fabrics in a stack of layers of substantially uniform dimensions widthwise and lengthwise, the layers being superimposed upon one another to form a stack of multiple layers numbering 130 or less, thereafter subjecting said stack of layers to mechanical pressure between upper and lower platens, supplying a first flow of fresh steam to one of said platens and simultaneously applying suction to the other of said platens, thereby causing said first flow of the steam to flow through the entire stack in one direction for a predetermined time period while maintaining said mechanical pressure thereon, and subsequently supplying a second flow of fresh steam to said other platen and simultaneously applying suction to said one platen causing said second flow of the steam to flow through the entire stack in the opposite direction for a second predetermined time period while maintaining said mechanical pressure thereon, and thereafter releasing said mechanical pressure.

2. A method according to claim 1 wherein the flat material is formed into a stack of layers numbering in the range of 96 to 128.

3. A method according to claim 1 wherein the stack is formed by folding the flat goods upon itself a multiple number of times to form multiple layers from a single piece of material.

* * * * *

UNITED STATES PATENT AND TRADEMARK OFFICE

CERTIFICATE OF CORRECTION

PATENT NO. : 4,274,215

DATED : June 23, 1981

INVENTOR(S) : Don L. Pertl

It is certified that error appears in the above-identified patent and that said Letters Patent are hereby corrected as shown below:

Column 1, line 55, "occuplies" should read --occupies--.
Column 2, line 55, "+ inches" should read --30 inches--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*